United States Patent [19]

Ohgami et al.

[11] 4,402,292

[45] Sep. 6, 1983

[54] AIR-FUEL RATIO CONTROL SYSTEM

[75] Inventors: Masaaki Ohgami; Fujio Matsui, both of Musashino, Japan

[73] Assignees: Fuji Jukogyo Kabushiki Kaisha, Tokyo; Nissan Motor Co., Ltd., Yokohama, both of Japan

[21] Appl. No.: 240,639

[22] Filed: Mar. 5, 1981

[30] Foreign Application Priority Data

Mar. 7, 1980 [JP] Japan ..... 55-29331

[51] Int. Cl.[3] ..... F02D 35/00

[52] U.S. Cl. ..... 123/440; 123/489

[58] Field of Search ..... 123/440, 489

[56] References Cited

U.S. PATENT DOCUMENTS

| | | | |
|---|---|---|---|
| 4,290,400 | 9/1981 | Pomerantz | 123/440 |
| 4,320,730 | 3/1982 | Takada et al. | 123/440 |
| 4,356,797 | 11/1982 | Matsui | 123/440 |
| 4,363,305 | 12/1982 | Ohgami et al. | 123/440 |

FOREIGN PATENT DOCUMENTS

| | | | |
|---|---|---|---|
| 55-49550 | 4/1980 | Japan | 123/440 |

*Primary Examiner*—Tony M. Argenbright

*Attorney, Agent, or Firm*—Martin A. Farber

[57] ABSTRACT

An air-fuel ratio control system for an internal combustion engine having an intake passage, an exhaust passage, an air-fuel mixture supply device, an on-off type electromagnetic valve for correcting the air-fuel ratio of the air-fuel mixture supplied by the air-fuel mixture supply device, a dither signal generating circuit for producing a periodical dither signal, a shift control circuit for shifting the level of the center of the dither signal, a driving circuit for producing a driving output for the on-off type electromagnetic valve, and an $O_2$ sensor for detecting the concentration of oxygen in exhaust gases passing through the exhaust passage. A timing circuit is provided for detecting the period of the time when the output of the $O_2$ sensor is higher than a predetermined level and the period of the time when the output is lower than the predetermined level for producing an output signal in dependency on the difference between the periods. A shift signal generating circuit is provided for generating a shift signal in dependency on the output of the timing circuit. The shift control circuit is so arranged to control the air-fuel ratio of the mixture in such a direction that the difference is decreased.

2 Claims, 11 Drawing Figures

AIR-FUEL RATIO CONTROL SYSTEM

BACKGROUND OF THE INVENTION

The present invention relates to a system for controlling the air-fuel ratio for an internal combustion engine emission control system which comprises a three-way catalyst, and more particularly to a system for controlling the air-fuel ratio to a value approximating the stoichiometric air-fuel ratio so as to effectively operate the three-way catalyst.

Such a system is feedback control system, in which an $O_2$ sensor is provided to detect the oxygen content of the exhaust gases to generate an electrical signal as an indication of the air-fuel ratio of the air-fuel mixture supplied by a carburetor. The control system comprises a comparator for comparing the output signal of the oxygen sensor with a predetermined value, an integrating circuit connected to the comparator, a driving circuit for producing square wave pulses from the output signal of the integrating circuit, and an on-off type electromagnetic valve for correcting the air-fuel ratio of the mixture. The control system operates to determine whether the feedback signal from the $O_2$ sensor is higher or lower than a predetermined reference value corresponding to the stoichiometric air-fuel ratio for producing an error signal for actuating the on-off type electromagnetic valve to thereby control the air-fuel ratio of the mixture.

In the conventional system, as shown in FIGS. 1*a* and 1*b*, the output waveform $P_1$ of the $O_2$ sensor varies from a maximum output voltage thereof to a minimun one, because the $O_2$ concentration in the exhaust gases exceeds values corresponding to the maximum and minimum outputs due to the control delay of the control system. As shown in FIG. 1*a*, the output voltage of the $O_2$ sensor varies steeply at a reference voltage $V_R$ which corresponds to the output voltage caused by exhaust gases when a mixture of the stoichiometric air-fuel ratio (St) is supplied to the engine and burned. Therefore, it may be regarded that a middle value M between the maximum and minimum values in each cycle of the output waveform of the $O_2$ sensor is constant and substantially equal to the voltage $V_R$ corresponding to the stoichiometric air-fuel ratio. Thus, in the conventional system, the middle value M is set as the reference value of the comparator for comparing the air-fuel ratio of the mixture supplied to the engine.

On the other hand, copending patent application Ser. No. 174,385, now U.S. Pat. No. 4,378,773, which was assigned to the same assignee as this patent application, discloses a system intended for improvement of the control delay in such a conventional system, in which the on-off electromagnetic valve is operated by a dither signal having a high frequency and a small amplitude. However, it is not proper to use the middle value of each cycle in the output waveform $P_2$ of the $O_2$ sensor dependent on the dither signal D as a reference value, because the middle value of the output waveform of the $O_2$ sensor does not always coincide with the reference voltage $V_R$ corresponding to the stoichiometric value, as shown in FIG. 1*b*. Therefore, the middle value cannot be used as the reference value.

SUMMARY OF THE INVENTION

The object of the present invention is to provide an air-fuel ratio control system which controls the air-fuel ratio to the stoichiometric air-fuel ratio without using a reference value as a stoichiometric air-fuel ratio, whereby the air-fuel ratio can be exactly controlled to the stoichiometric air-fuel ratio.

According to the present invention there is provided an air-fuel ratio control system for an internal combustion engine having an intake passage, an exhaust passage, an air-fuel mixture supply means, a on-off type electromagnetic valve for correcting the air-fuel ratio of the air-fuel mixture supplied by the air-fuel mixture supply means, dither signal generating circuit means for producing a periodical dither signal, a shift control circuit means for shifting the level of the center of the dither signal, driving circuit means for producing a driving output for the on-off type electromagnetic valve, and an $O_2$ sensor for detecting the concentration of the oxygen in the exhaust gases passing through the exhaust passage, with the improvement comprising first circuit means for producing a reference value, timing circuit means for detecting the period of the time when the output of said $O_2$ sensor is higher than the reference value and the period of the time when the output of the $O_2$ sensor is lower than the reference value for producing an output signal dependent on the difference between the periods, and shift signal generating circuit means for generating a shift signal in dependency on the output of the timing circuit means, the shift control circuit means being so arranged to control the air-fuel ratio of the mixture in such a direction that the difference is decreased.

Other objects and features of the present invention will be apparent from the following description with reference to the accompanying drawings.

DETAILED DESCRIPTION OF THE PREFERRED EMBODIMENTS

Figure 4:
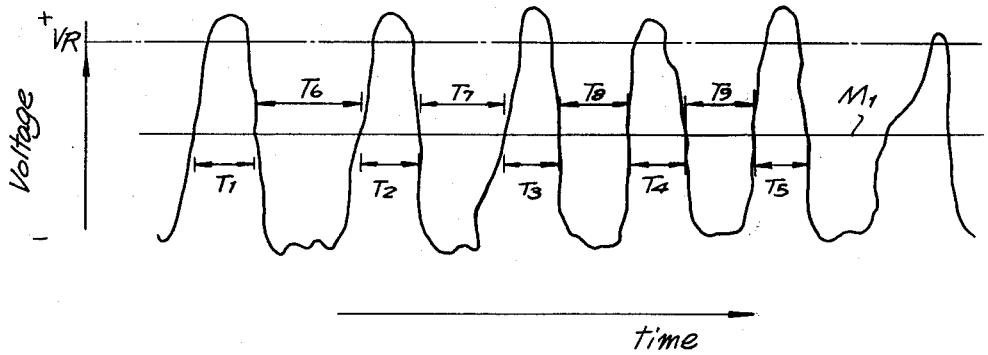
FIG. 4 is a graph showing the output waveform of the $O_2$ sensor.

Now describing the principle of the present invention referring to FIG. 4, the figure shows the output waveform of the $O_2$ sensor when the level of the output voltage is lower than the reference voltage $V_R$, which means that a lean air-fuel mixture is supplied to the engine. Because of the lower output voltage, the bottom of the waveform is limited to a low voltage due to the characteristics of the $O_2$ sensor. Therefore, an upper half and a lower half of the waveform of each cycle are different in shape. The reference $M_1$ shows a middle value of the height of the wave. By such deformation of the wave, each of the times $T_1$ to $T_5$ when the output voltage of the $O_2$ sensor is higher than the middle value $M_1$ is smaller than each of times $T_6$ to $T_9$ when the output voltage is lower than the middle value $M_1$. If the middle value $M_1$ between the maximum voltage and the minimum voltage of each cycle in the output waveform coincides with the reference voltage $V_R$, the times of the higher and the lower portions of each cycle are equal.

Thus, in accordance with the present invention, the air-fuel ratio of the mixture is controlled so that the times of the wave portions higher and lower than the middle value M, may be equal.

Figures 1A, 1B:
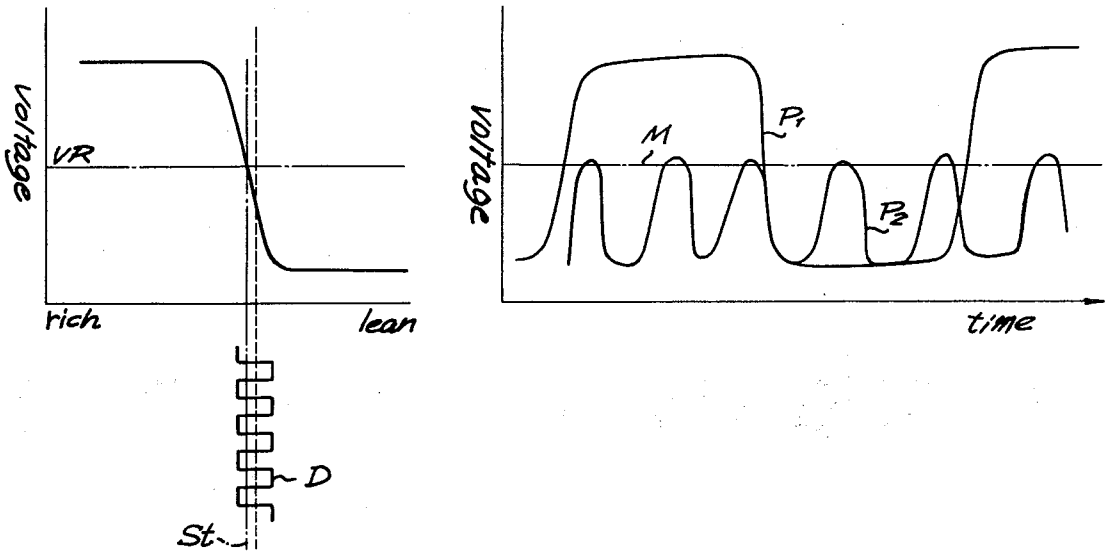
FIG. 1a PRIOR ART
FIG. 1b PRIOR ART
FIGS. 1*a* and 1*b* are graphs showing the output signal of the $O_2$ sensor of a conventional system.
Figure 2:
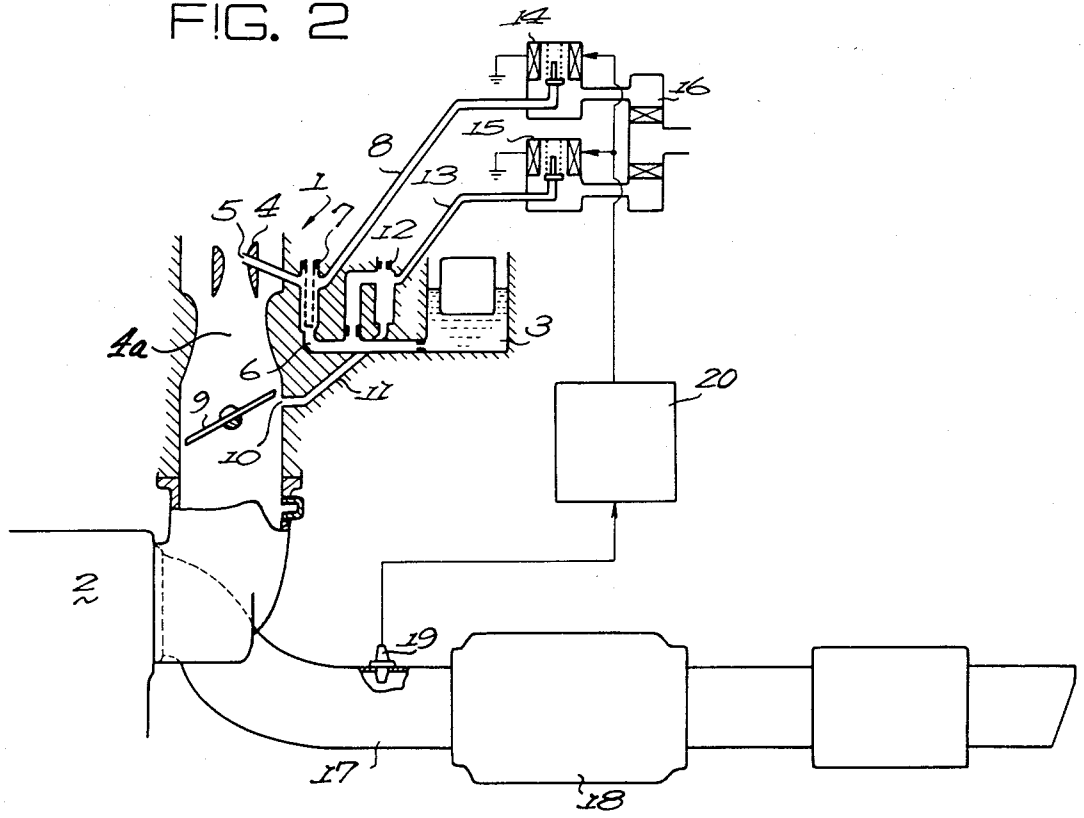
FIG. 2 is a schematic view of a system according to the present invention.

Referring to FIG. 2, a carburetor 1 communicates an internal combustion engine 2. The carburetor 1 comprises a float chamber 3, a venturi 4 formed in an intake passage 4*a*, a nozzle 5 communicating with the float chamber 3 through a main fuel passage 6, and a slow port 10 provided near a throttle valve 9 in the intake passage communicating with the float chamber 3 through a slow fuel passage 11. Air correcting passages 8 and 13 are disposed in parallel to a main air bleed 7 and a slow air bleed 12, respectively. On-off type electromagnetic valves 14 and 15 are provided for the air correcting passages 8 and 13, respectively. Inlet ports of each on-off electromagnetic valve 14 and 15 respectively communicates with the atmosphere through an air filter or air cleaner 16. An $O_2$ sensor 19 is disposed in an exhaust pipe 17 which communicates with the internal combustion engine 2. The $O_2$ sensor 19 detects the oxygen content of the exhaust gases. A three-way catalytic converter 18 is provided in the exhaust pipe 17 downstream of the $O_2$ sensor 19. The output signal of the $O_2$ sensor 19 is applied to an electronic control circuit 20 of an electronic control system. The electronic control circuit 20 operates to correct the air-fuel ratio of the air-fuel mixture provided by the carburetor 1.

Figure 3:
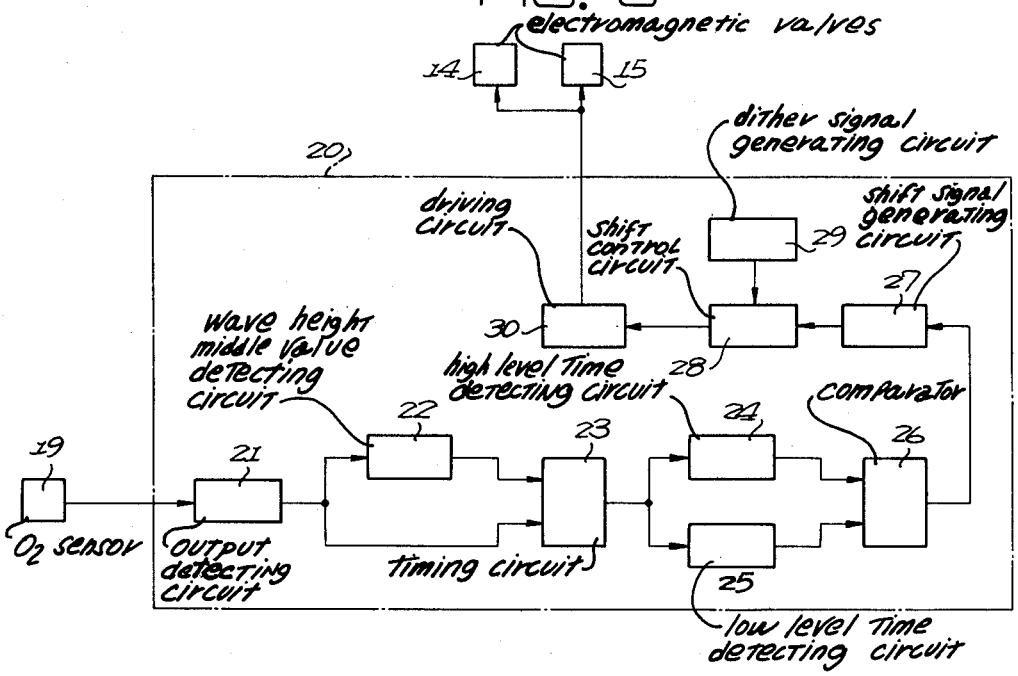
FIG. 3 is a block diagram of an electronic control circuit of the system.

FIG. 3 shows the block diagram of the electronic control circuit 20.

The output of the $O_2$ sensor 19 is connected to an output detecting circuit 21. One of outputs of the circuit 21 is connected to a timing circuit 23 through a wave height middle value detecting circuit 22 and the other is directly connected to the timing circuit 23. The output of the timing circuit 23 is connected to a high level time detecting circuit 23 and to a low level time detecting circuit 25. Outputs of both circuits 24 and 25 are connected to a comparator 26 for comparing both outputs. The output of the comparator 26 is connected to a shift signal generating circuit 27 which is adapted to generate a shift signal dependent on the output signal of the comparator 26. The output of the shift signal generating circuit 27 is connected to the shift control circuit 28 which acts to shift the center of a dither signal fed from a dither signal generating circuit 29 in dependency on the output of the shift signal generating circuit 27. The output of the shift control circuit 28 is fed to on-off type electromagnetic valves 14 and 15 through a driving circuit 30 for actuating the valves 14 and 15 so as to control the air-fuel ratio of the mixture.

In accordance with the present invention, the shift control circuit 28 operates to shift the center of the dither signal in such a direction that the difference between the outputs of the circuits 24 and 25 is decreased. Thus, the air-fuel ratio of the mixture can be controlled to the stoichiometric air-fuel ratio.

Figure 5:
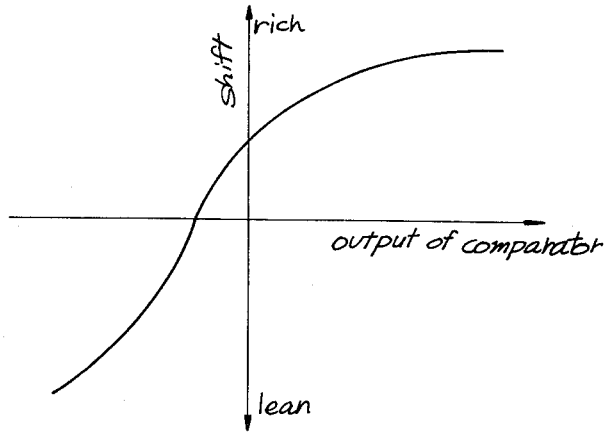
FIG. 5 shows an example of the relation between the output of a comparator and the shifting of the dither signal.

In the case where there is a difference between the controlled air-fuel ratio and the stoichiometric air-fuel ratio due to an error of the characteristic of the $O_2$ sensor, the shift signal is modulated in accordance with a suitable function. FIG. 5 shows an example of the modulation of the shift signal.

Figure 6:
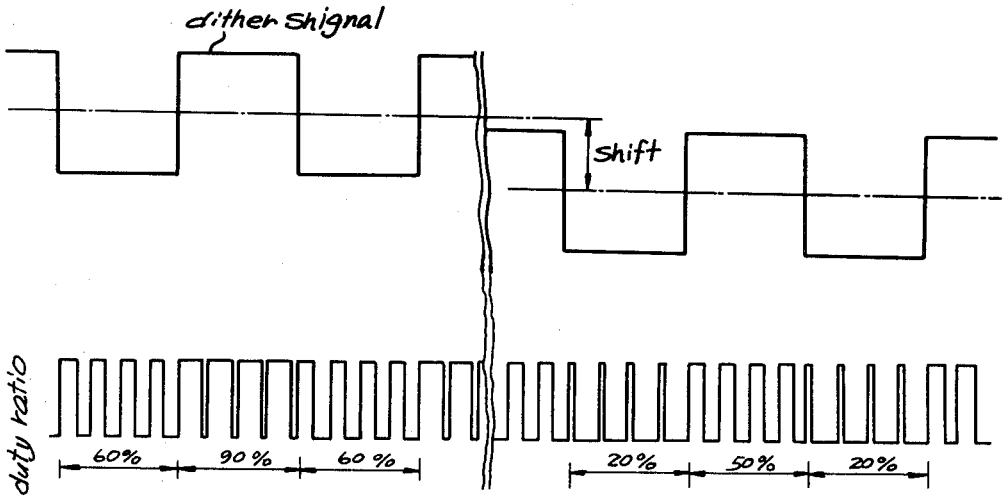
FIG. 6 is a graph showing the relation between the dither signal and the operation of the valve.

FIG. 6 shows the relation between shifting of the dither signal and the duty ratio of the electromagnetic valve. When the level of the dither signal is low, the duty ratio is small. The left half of FIG. 6 shows the condition when the dither signal deviates to the higher side and the right half shows when the dither signal is in a lower level. From the figure, it will be seen that the air-fuel ratio of the mixture is controlled by shifting the dither signal.

Figure 7:
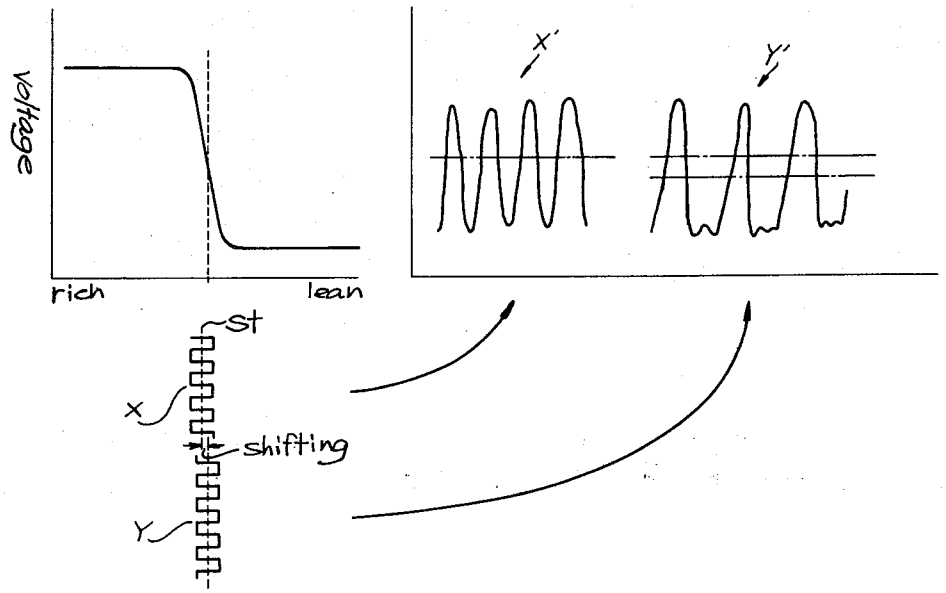
FIG. 7 is a graph showing the operation of the system of the present invention.

For an engine having a characteristic where the exhaust gases contain a large amount of CO and small amount of NOx and HC, the system should operate to sufficiently reduce the amount of CO. In order to reduce CO rather than NOx and HC, it is known that it is effective to control the air-fuel ratio to a slightly leaner side than the stoichiometric air-fuel ratio. On the contrary, in some cases, it is preferable to control the air-fuel ratio to the rich side. In the system of the present invention, it is easy to shift the air-fuel ratio of the mixture to either side. FIG. 7 shows the example of the lean side control. Dither variation X included in the exhaust gases oscillates centering on a value corresponding to the stoichiometric value and the output of $O_2$ sensor is shown by X'. Reference Y shows a lean-controlled dither variation and Y' shows the output of the $O_2$ sensor.

Figure 8:
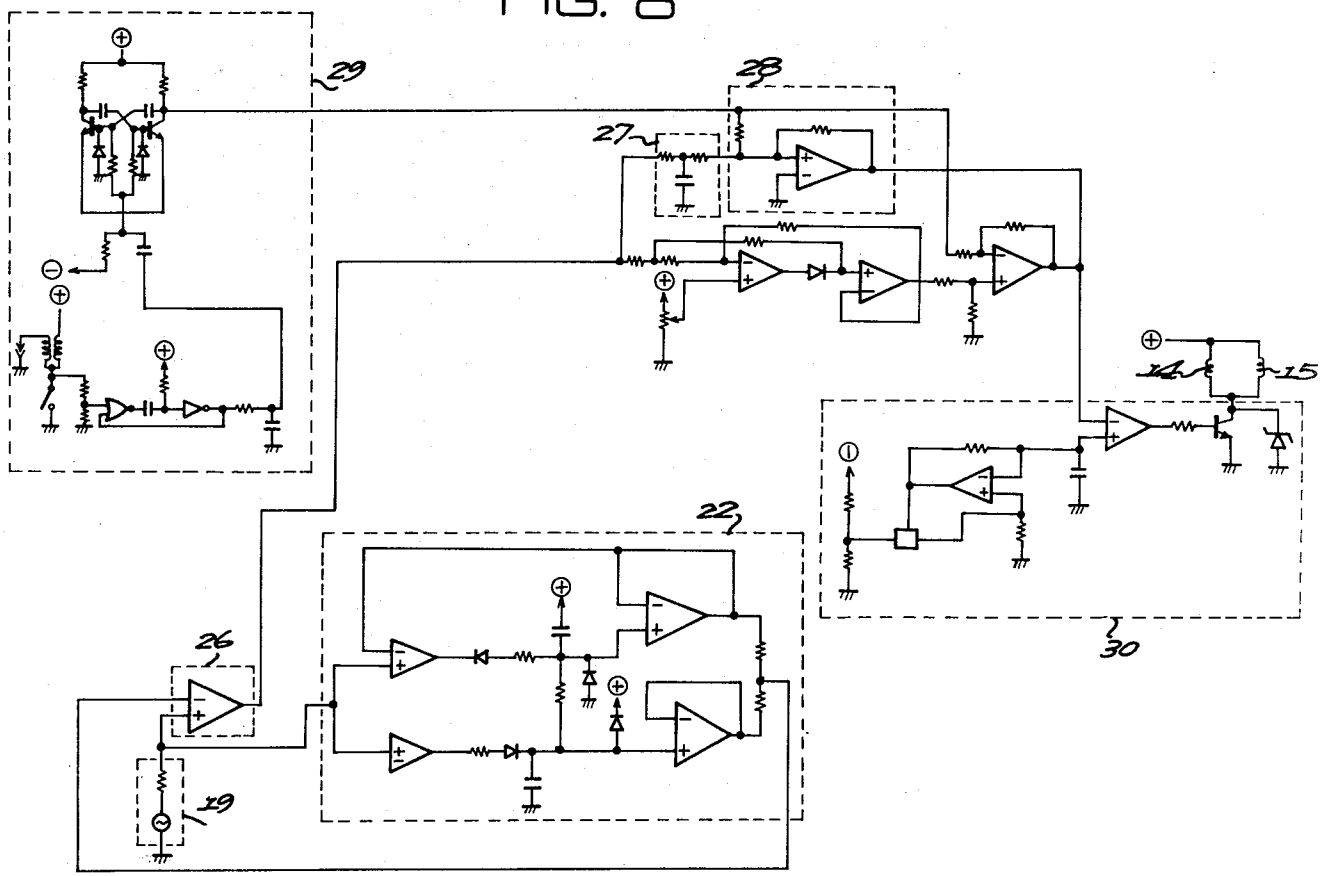
FIG. 8 shows an example of the electronic control circuit.

FIG. 8 shows an example of the electronic control circuit of the present invention. The same parts as FIG. 3 are identified by the same numerals. In the circuit, operations of the output detecting circuit 21, the timing circuit 23, and the high and low level time detecting circuits 24 and 25 are included in other circuits 22 and 26.

Figure 9:
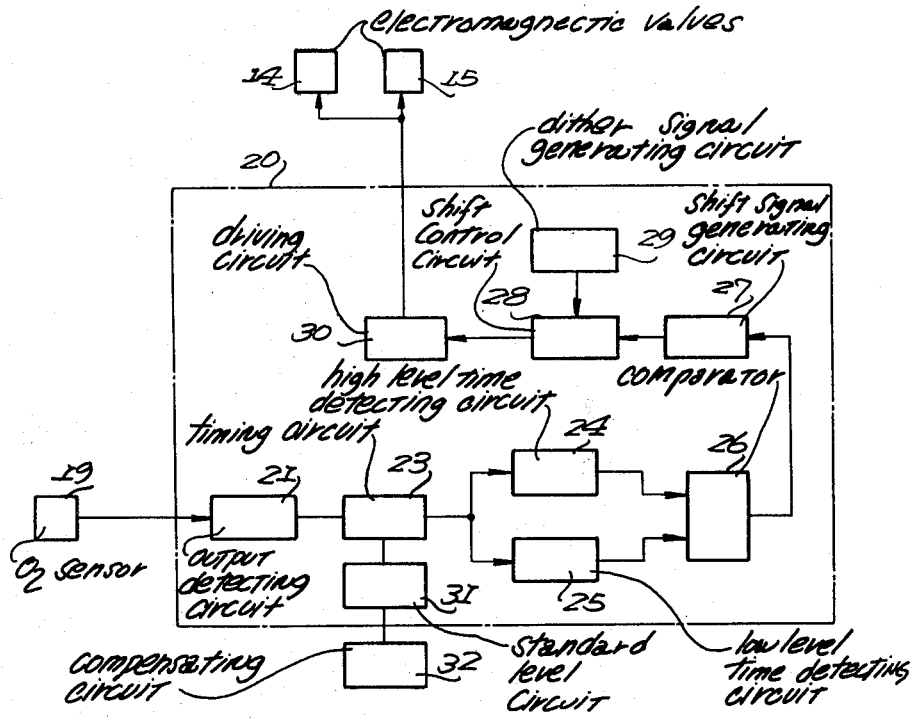
FIG. 9 shows a block diagram of another embodiment of the present invention.

FIG. 9 shows another embodiment of the present invention. In this system, a standard level circuit 31 is connected to the timing circuit 23 and a compensating circuit 32 is connected to the standard level circuit 31 for adjusting the standard level in dependency on the temperature of the cooling water of the engine or the opening degree of the throttle valve and the like. The standard level is applied to the timing circuit 23, so that the output of the $O_2$ sensor 19 is compared with the standard level.

The high level time detecting circuit 24 and the low level time detecting circuit 25 detect the output of the timing circuit 23. Other operations are the same as the operations of the previous embodiment.

Figure 10:
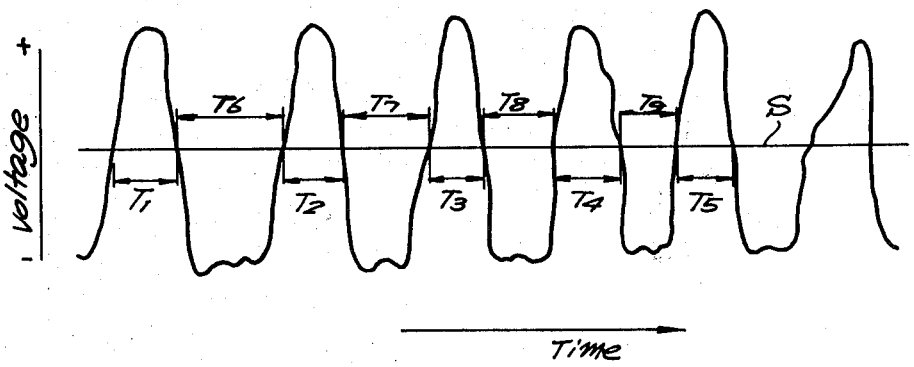
FIG. 10 is a graph showing the output waveform of the $O_2$ sensor in the system of FIG. 9.

FIG. 10 shows the waveform of the $O_2$ sensor. The standard level is designated by S.

It will be understood that the system of the present invention may also be composed of digital circuit means.

What is claimed is:

1. In an air-fuel ratio control system for an internal combustion engine having an intake passage, an exhaust passage, an air-fuel mixture supply means, an on-off type electromagnetic valve for correcting the air-fuel ratio of the air-fuel mixture supplied by said air-fuel mixture supply means, dither signal generating circuit means for producing a periodical dither signal, a shift control circuit means for shifting the level of the center of said dither signal, driving circuit means for producing a driving output for said on-off type electromagnetic valve, and an $O_2$ sensor means for detecting the concentration of oxygen in exhaust gases passing through said exhaust passage, the improvement comprising first circuit means for producing a reference value;

timing circuit means for detecting the period of time when the output of said $O_2$ sensor means is higher than said reference value and the period of time when the output of said $O_2$ sensor means is lower than said reference value for producing an output signal dependent on the difference between said periods; and shift signal generating circuit means for generating a shift signal in dependency on the output of said timing circuit means;

said shift control circuit means for controlling the air-fuel ratio of the mixture in such a direction that said difference is decreased.

2. An air-fuel ratio control system for an internal combustion engine according to claim 1, wherein said reference value is a middle value between the maximum value and the minimum value of the output voltage of said $O_2$ sensor means.

* * * * *